United States Patent [19]

Francovitch

[11] Patent Number: 4,467,581

[45] Date of Patent: Aug. 28, 1984

[54] MEMBRANE ANCHOR SYSTEM WITH METAL BODY

[75] Inventor: Thomas F. Francovitch, Columbia, Md.

[73] Assignee: Single-Ply Institute of America, Inc., Columbia, Md.

[21] Appl. No.: 352,061

[22] Filed: Feb. 24, 1982

[51] Int. Cl.[3] ..... E04D 3/36; E04B 7/00

[52] U.S. Cl. ..... 52/410; 52/512; 411/542

[58] Field of Search ..... 52/364, 366, 549, 410, 52/512, 514; 411/531, 542, 545, 260, 261, 314, 544, 155, 156; 405/259

[56] References Cited

U.S. PATENT DOCUMENTS

| | | | |
|---|---|---|---|
| 1,111,034 | 9/1914 | Robertson | 411/531 |
| 2,020,762 | 11/1935 | Bullis et al. | 411/542 |
| 3,343,227 | 9/1967 | Brown et al. | 52/408 |
| 3,918,233 | 11/1955 | Simpson | 52/747 |
| 3,948,412 | 4/1976 | Bennett | 52/410 |
| 4,026,183 | 5/1977 | Bart | 411/542 |
| 4,037,418 | 7/1977 | Hannan | 405/259 |
| 4,074,492 | 2/1978 | Simpson et al. | 52/509 |
| 4,074,501 | 2/1978 | Sandqvist | 52/741 |
| 4,102,239 | 7/1978 | Dallas | 411/531 |
| 4,162,597 | 7/1979 | Kelly | 52/410 |
| 4,359,849 | 11/1982 | Goeman | 52/DIG. 6 |
| 4,361,997 | 12/1982 | De Caro | 411/542 |
| 4,389,826 | 6/1983 | Kelly | 52/741 |

FOREIGN PATENT DOCUMENTS

| | | | |
|---|---|---|---|
| 1222640 | 6/1960 | France | 405/259 |
| 2330901 | 3/1977 | France | 411/531 |
| 7415863 | 6/1976 | Netherlands | 411/545 |

*Primary Examiner*—J. Karl Bell

*Attorney, Agent, or Firm*—Irvin A. Lavine

[57] ABSTRACT

A body for use in a membrane anchor system made of resilient metal a central region with an opening therein, a downwardly sloping region and a peripheral region outwardly of the downwardly sloping region. An anchor system including said body, wherein a linear fastener extends through the body and through a membrane, and mastic is placed between the body and the membrane.

An anchor system utilizing the said body, and having a sheet of water-impervious material extending over and beyond the body, and adhered to the body and the membrane.

13 Claims, 6 Drawing Figures

MEMBRANE ANCHOR SYSTEM WITH METAL BODY

TECHNICAL FIELD

The present invention relates to an anchor system for a membrane used as a roofing material to prevent moisture from entering a structure such as a building.

BACKGROUND ART

It is conventional to apply membranes to roofs in order to prevent the entry of moisture into the structure of which the roof forms a part. These membranes are made of a synthetic, rubber-like material which is flaccid and waterproof and typically are 3/64" thick; they are supplied in rolls of 100' length and vary in width from 4'6" to 45'.

There have been four systems utilized for fastening the membranes. In the adhered system, a suitable cement is applied to the substructure surface and the rubber-like membrane applied over it; there is an overlap of one membrane sheet with the next, so as to provide a water impervious lap joint. A partially adhered method or system is used, wherein the bonding of the membrane takes place at special plate areas or locations. The ballasted system involves the holding down of the membrane with a layer of small stones. There is also used a mechanically fastened system, in which battens or other strips are placed on the membrane and are adhered, with complex systems for connecting the batten and sealing it. The batten is a strip of rubber, plastic, or metal material and is utilized in order not only to hold the sheet down against wind forces which might tend to lift it (as do the other systems) but also prevents or retards creeping movement of the sheet due to the expansion and contraction. The seal utilized with the batten strip is a small membrane sheet which entirely covers the batten strip and which is glued down over the entire strip. All of the foregoing systems suffered either from expense of installation, or expense of materials, or both.

DISCLOSURE OF INVENTION

The present invention is directed to a metal, resilient body for anchoring roofing membrane, and to an anchor system utilizing such body. The membrane is of a known construction, being of rubber-like material, and is in the form of a sheet which is applied over a roof substrate. The body is of resilient metal, and is relatively thin in comparison to its lateral extent; preferably, the body is a disc, and has upper and lower surfaces. The body includes a central, substantially planar region having an opening centrally-therein, and outwardly of the central region there is provided a downwardly facing cavity, being defined by a region lying above the central region, surrounding the central region, and defining above the central region a recess. In surrounding relationship to the cavity is a groove which defines the outer extent of the cavity, and in surrounding relationship to the groove is a downwardly and outwardly sloping intermediate region which extends to a flexure zone at its outer boundary, there being an outer engaging region in surrounding relation to the flexure zone. The body, when in the unstressed condition, has the outer engaging region at a level lower than the cavity defining region and central region. The downwardly sloping intermediate region defines a mastic overflow cavity , and has a bending zone inwardly of it, so that when a linear fastener is passed through the opening, mastic applied to the lower surface of the body in the cavity may overflow into the overflow cavity.

In one embodiment of an anchoring system, utilizing the noted body, the body is placed in positon over a membrane, and the linear fastener is passed through the opening, so as to stress the body, resulting in the central region, groove lower surface and outer engaging region engaging the membrane, with mastic in the inner cavity and in the mastic overflow cavity. Sealant is provided over the head of the fastener, in the recess in the upper surface.

In another system, mastic extends substaintally beneath the body, between the body and the membrane there beneath. Sealant is provided over the head of the fastener, and a sheet extends over and beyond the body. An adhesive is provided between the body and the sheet, for adhering them together and an adhesive is provided between the sheet and the membrane, for adhering them together. Only the outer engaging region engages the membrane. Mastic is provided at the edge of the sheet, preventing entry of moisture underneath the sheet.

BEST MODES FOR CARRYING OUT THE INVENTION

Figure 1:
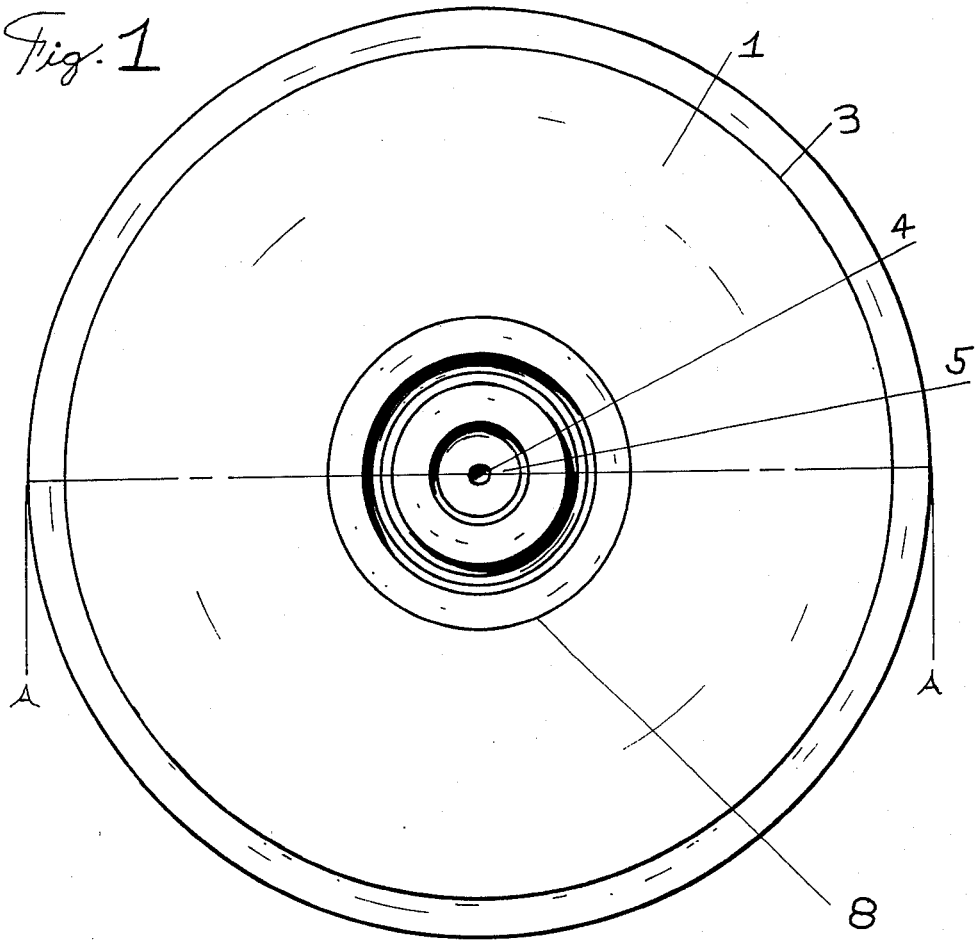
FIG. 1 is a top plan view of a metal body in accordance with the present invention.
Figure 2:
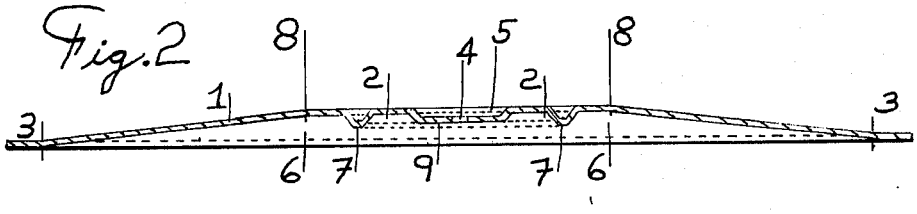
FIG. 2 is a cross-sectional view taken on the line A—A of FIG. 1.
Figure 3:
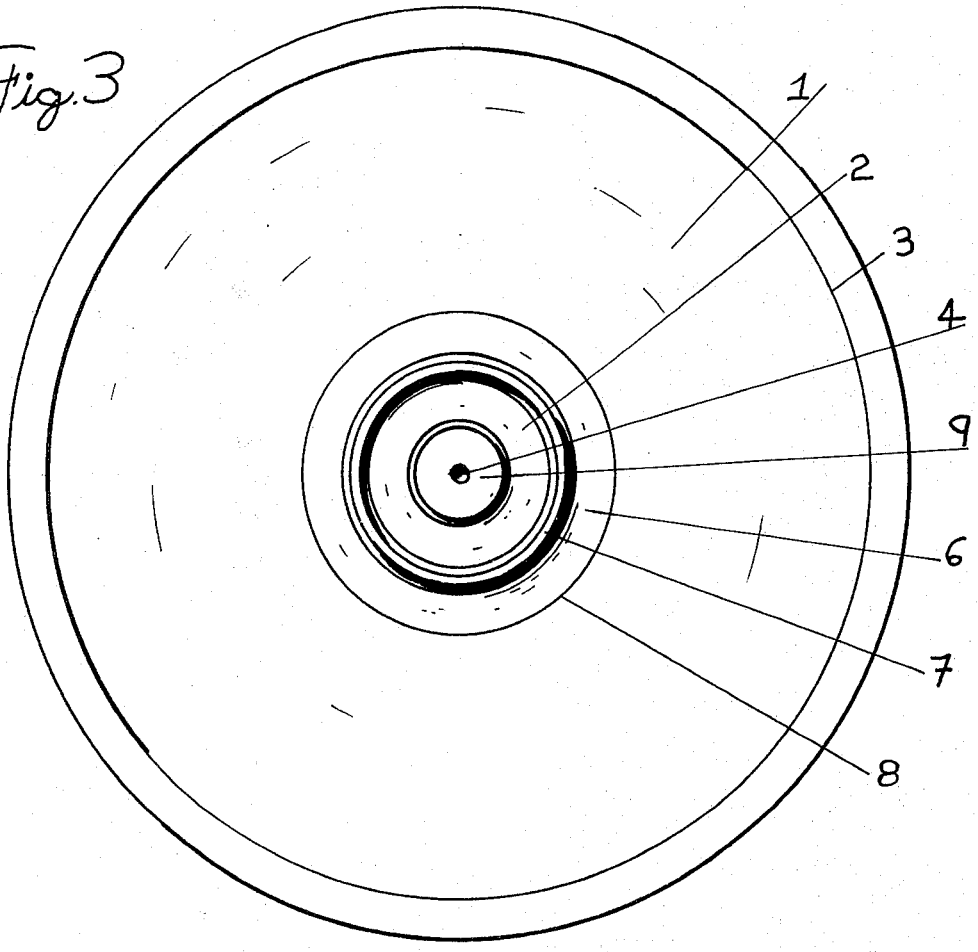
FIG. 3 is a bottom plan view of the body of FIG. 1.

Referring now to the drawing, wherein like or corresponding reference numerals are used to designate like or corresponding parts throughout the several views, there is shown in FIGS. 1–4 a body 1 of a suitable metal, body 1 being preferably of disc shape, and being relatively thin (see FIGS. 2 and 4) in comparison to the lateral extent thereof. The body 1 has an upper surface shown in FIG. 1, and a lower surface shown in FIG. 3. In FIG. 2, the body will be seen to have a central, substantially planar region 9, having an opening 4 centrally therein, and extending through the resilient metal body 1. A downwardly facing cavity 2 is provided outwardly of and in surrounding relationship to the central region 9, and is defined by an annular portion of the body 1 which is at a level above the level of the central region 9, thereby defining a recess in the upper surface above the central region 9.

Defining the outer extent of the cavity 2 is a groove 7. A downwardly sloping intermediate region extends outwardly from the groove and is provided with a peripherally extending flexure zone 3 at the outer boundary thereof, with an outer engaging region in surrounding relation to said flexure zone 3 and located at a level below the groove 7 and the central region 9 in the unstressed state of body 1 as shown FIGS. 2 and 4. The downwardly sloping intermediate region has at its inner boundary a bending zone 8 which will bend upon stressing of the body 1 in a manner to be hereinafter set forth.

Figure 4:
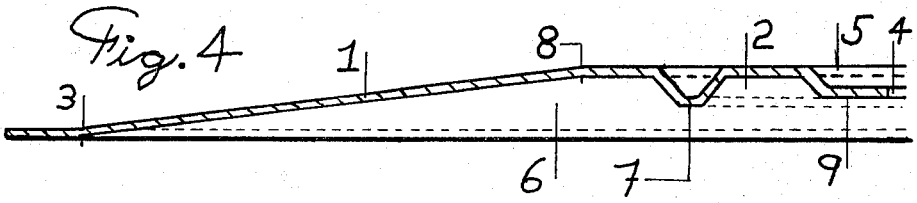
FIG. 4 is an enlarged view, similar to FIG. 2, of one-half of the body.

In the unstressed condition, as shown particularly in FIG. 4, it will be noted that the bottom of the groove 7 is slightly below the central region 9, and that the region defining the cavity 2 is at approximately the same level as the region of the body outwardly of the groove 7, which region of the body 1 extends to the bending zone 8, where the intermediate downwardly sloping region begins.

Figure 5:
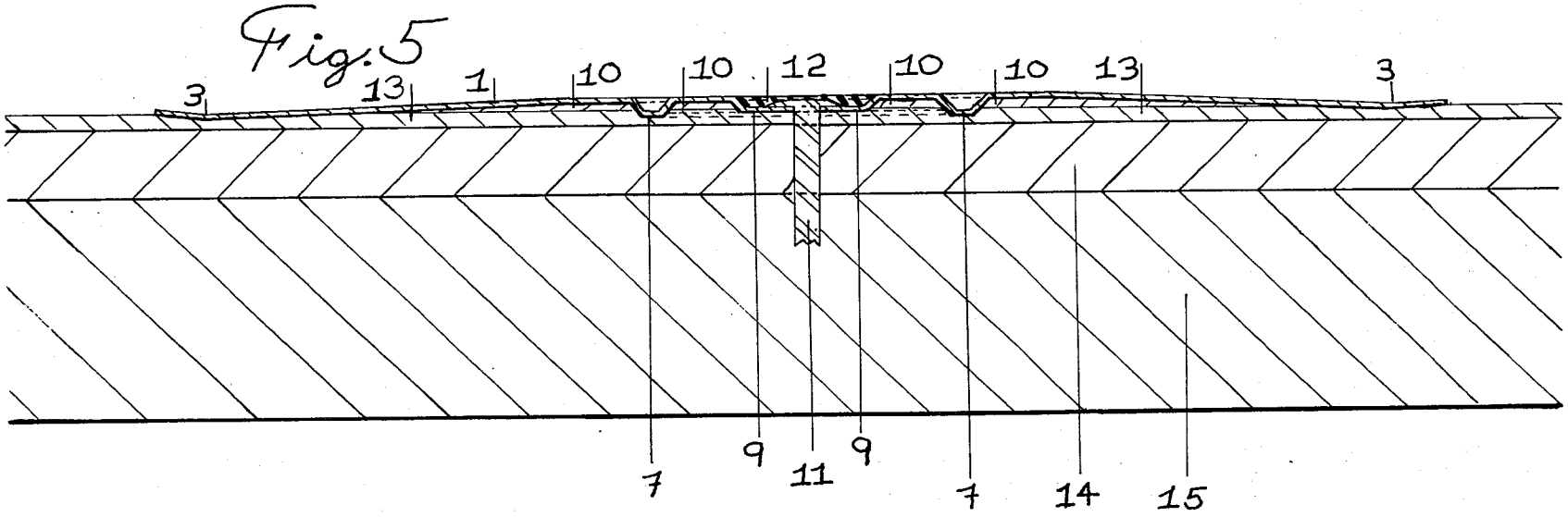
FIG. 5 is a cross-sectional view of a first anchor system including the body of FIG. 1.

Referring now to FIG. 5, there is shown a first embodiment of a membrane anchor system in accordance with the present invention and utilizing body 1 as shown in FIGS. 1–4. The system of FIG. 5 may be utilized where the roof has positive drainage, this being defined as the drainage condition in which consideration has been given for all loading deflections of the deck of the roof, and additional roof slope has been provided to ensure complete drainage of the roof area within 24 hours of rainfall precipitation. In the structure shown in FIG. 5, there is provided a deck substrate 15, over which is an insulating substrate 14. A headed, linear fastener 11 has been passed through the opening 4, and driven into the substrates, one or both, so as to stress and deflect the body 1. A rubber-like flexible and water impervious membrane 13 having been applied over the substrate 14, the bottom surface of the groove 7 and the central region 9 are in juxtaposition with and engage the membrane 13, as does the outer engaging region. Engagement of membrane 13 by the bottom of groove 7 and/or central region 9 limits the deformation of body 1 at the flexure zone 3 when the body 1 is stressed by the linear fastener 11. Mastic 10 is provided in the cavity 2, and is also provided in the cavity 6 under the portion of the body 1 outwardly of the groove 7. The anchor system of FIG. 5 provides a substantially water impervious mechanical anchoring system for the membrane 13, holding it securely in place while permitting some "creep" or movement thereof to accommodate expansion and contraction. Sealant 12 will be seen to be in place over the head of the headed fastener 11, in the recess 5, assuring against penetration of moisture by movement under the head of fastener 11 and along the shank thereof.

Figure 6:
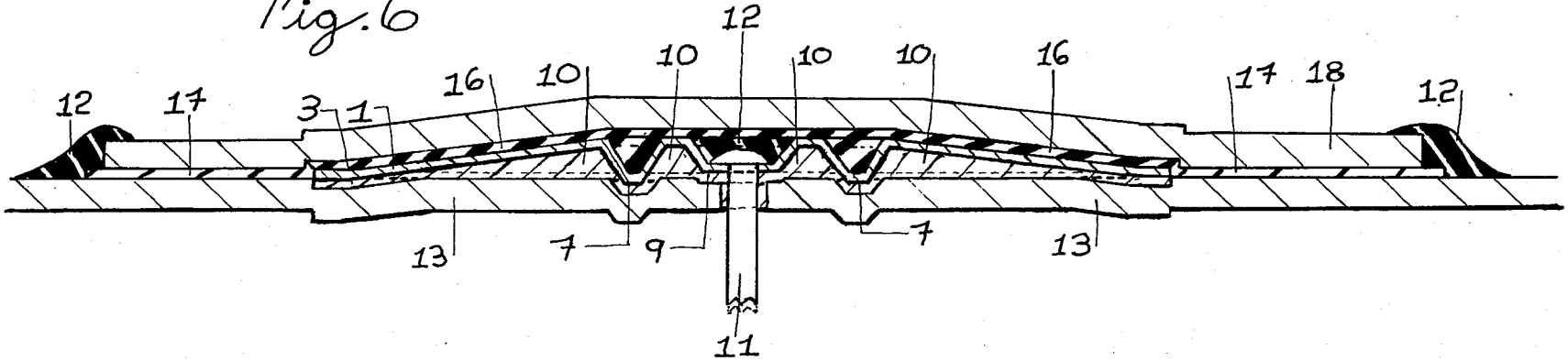
FIG. 6. is a cross-sectional view of a second anchor system including the body of FIG. 1.

In FIG. 6 there is shown a second embodiment of an anchoring system utilizing the body 1 of FIGS. 1–4. The system of FIG. 6 has an application where there is no or insufficient positive drainage, in which case there is "ponding", meaning water remaining on the roof surface 24 hours after rainfall precipitation.

The substrates, shown in FIG. 5, are omitted for purpose of clarity. There is shown in FIG. 6 the headed fastener 11, with sealant 12, the fastener 11 having been driven or otherwise urged into the substrate of substrates, tending to stress the body 1 towards a flattened condition in which the groove 7 is substantially at the level of the peripheral region and is in juxtaposition with membrane 13, slightly spaced from it. Mastic 10 extends substantially entirely beneath the stressed, deformed body 1, to the outer engaging region thereof, and occupying the space between the body 1 and the membrane 13. Sealant 12 is provided above the head of headed fastener 11, and in the groove 7. A sheet 18 of suitable water-impervious material is provided, sheet 18 being preferably of the same material as membrane 13. Sheet 18 extends over an beyond the body 1. Between sheet 18 and body 1 is an adhesive 16 which is capable of bonding them. Between the sheet 18 and the membrane 13 is an adhesive 17 which is capable of bonding them. Mastic 12, in the form of a bead, is provided at the outer edge of sheet 18, engaging the outer edge of the adhesive 17 and the upper surface of membrane 13.

The anchor system disclosed in FIG. 6 is impervious to the penetration of moisture, the construction ensuring against the penetration of moisture along any mating surfaces which would permit it to penetrate through the membrane 13.

In the systems of FIG. 5 and of FIG. 6, the body 1 may be placed on four foot centers, to securely anchor the underlying membrane, and also to prevent entry of moisture which would penetrate the membrane.

I claim:

1. In a membrane anchor system in which a roof substrate is covered with a membrane of water impervious material anchored by linear fasteners which penetrate the membrane and are secured to underlying roof structure, a resilient thin disc-like body for engaging said membrane having upper and lower surfaces, said body having an unstressed state and being deformable to a stressed state under load imposed by the linear fastener, and comprising:

(a) a central, substantially planar region, (b) an opening through said body in said central region for a linear fastener, (c) means defining a downwardly facing cavity above said membrane outwardly of and surrounding said central region and said opening, said means in part extending above said central region thereby defining in the upper surface a recess above said central region, (d) means defining a groove in surrounding relationship to said cavity defining means, (e) an intermediate region extending outwardly of said groove and having an outer boundary, a peripherally entending flexure zone in said body at said outer boundary, (f) an outer engaging region in surrounding relation to said flexure zone and located at a level below the bottom surface of said groove in the unstressed state of said body, said outer engaging region engaging said membrane in the stressed state of said body, (g) said intermediate region defining therebeneath a mastic overflow cavity outwardly of said groove, and having a bending zone at its inner boundary.

2. The structure of claim 1, and (a) a linear fastener in said opening having a head in said recess, (b) mastic in said cavities and beneath said intermediate region, and (c) sealant over said head in said recess.

3. The structure of claim 1, and (a) a linear fastener in said opening having a head in said recess, and causing said central region to be at approximately the level of said peripheral region, (b) a moisture impervious sheet over said body and extending outwardly of said body, (c) adhesive means securing said sheet and said body, and, (d) adhesive means securing said sheet and said membrane outwardly of said body.

4. The anchor system of claim 1, and further comprising a headed fastener extending through the opening of said central region and through said membrane, and means for preventing passage of water past the head of said fastener.

5. The anchor system of claim 4, said water passage preventing means comprising a sheet of water impervious material over and extending beyond said body, means for securing said water impervious sheet to said body, and means for securing said water impervious sheet to said membrane outwardly of said body.

6. The anchor system of claim 5, and further comprising mastic engaging the edge of said water impervious sheet and said membrane.

7. The structure of claim 1, said central region, said groove and said outer engaging region contacting said membrane.

8. The structure of claim 7, wherein said intermediate region slopes downwardly towards said flexure zone.

9. The structure of claim 1, said central region and said groove being in closely spaced adjacent relationship to said membrane, and said outer engaging region being in contact with said membrane.

10. The structure of claim 9, wherein said intermediate region slopes downwardly towards said flexure zone.

11. The structure of claim 1, wherein said intermediate region slopes downwardly towards said flexure zone.

12. In a membrane anchor system in which a roof substrate is covered with a membrane of water impervious material anchored by linear fasteners which penetrate the membrane and are secured to underlying roof structure, a resilient thin disc-like body for engaging said membrane having upper and lower surfaces, said body having an unstressed state and being deformable to a stressed state under load imposed by the linear fastener, and comprising:

(a) a central, substantially planar region, (b) an opening through said body in said central region for the linear fastener, (c) means defining a downwardly facing cavity above said membrane outwardly of and surrounding said central region and said opening, (d) an intermediate region outwardly of said cavity defining means and having an outer boundary, a peripherally extending flexure zone in said body at said outer boundary, (e) an outer engaging region in surrounding relation to said flexure zone engaging said membrane, (f) said intermediate region being spaced from said membrane, and (g) means between said linear fastener and said outer engaging region in the stressed state of said body for limiting the deformation of said body when in the stressed state thereof.

13. In a membrane anchor system in which a roof substrate is covered with a membrane of water impervious material anchored by linear fasteners which penetrate the membrane and are secured to underlying roof structure, a thin disc-like body for engaging said membrane having upper and lower surfaces, and comprising:

(a) a central, substantially planar region, (b) an opening through said body in said central region having the linear fastener passing therethrough, (c) means defining a downwardly facing cavity above said membrane outwardly of and surrounding said central region and said opening, (d) an intermediate region outwardly of said cavity defining means and having an outer boundary, (e) an outer engaging region in surrounding relationship to said intermediate region and engaging said membrane, (f) said intermediate region being spaced from said membrane, and (g) means between said linear fastener and said outer engaging region and urged against said membrane by said linear fastener.

* * * * *